United States Patent [19]

Broad

[11] 4,074,926

[45] Feb. 21, 1978

[54] HIGH VOLTAGE ELECTRICAL CONNECTOR

[75] Inventor: Roy M. Broad, San Carlos, Calif.

[73] Assignee: The Scott & Fetzer Company, Cleveland, Ohio

[21] Appl. No.: 727,136

[22] Filed: Sept. 27, 1976

Related U.S. Application Data

[63] Continuation of Ser. No. 577,065, May 13, 1975, abandoned, which is a continuation-in-part of Ser. No. 470,943, May 17, 1974, abandoned.

[51] Int. Cl.[2] ..... H01R 13/52

[52] U.S. Cl. ..... 339/60 R; 339/256 R; 339/DIG. 3

[58] Field of Search ..... 339/59–61, 339/75, 89, 92, 111, 186, 256, 258, DIG. 3

[56] References Cited

U.S. PATENT DOCUMENTS

| | | | |
|---|---|---|---|
| 2,677,115 | 4/1954 | Stevens | 339/60 M |
| 2,952,830 | 9/1960 | Sperzel et al. | 339/59 R |
| 3,148,011 | 9/1964 | Brown | 339/60 R |
| 3,243,756 | 3/1966 | Ruete et al. | 339/60 R |
| 3,344,391 | 9/1967 | Ruete | 339/60 R |
| 3,585,568 | 6/1971 | Hervig | 339/60 R |
| 3,614,711 | 10/1971 | Anderson et al. | 339/186 M |
| 3,652,975 | 3/1972 | Keto | 339/111 |
| 3,656,084 | 4/1972 | Malia | 339/60 R |
| 3,963,295 | 6/1976 | Askman et al. | 339/60 R |

FOREIGN PATENT DOCUMENTS

| | | | |
|---|---|---|---|
| 434,442 | 9/1955 | United Kingdom | 339/89 M |

*Primary Examiner*—Joseph H. McGlynn
*Attorney, Agent, or Firm*—Carothers and Carothers

[57] ABSTRACT

A universal electrical connector particularly adaptable for terminus applications of high voltage cables. The insulative body portions of the connector employ a combination of engaging primary and secondary tapers. One body portion represents a plug member and the other body portion represents a socket member. Each body portion taper is a frusto-conical contour. The primary set of mating plug and socket tapers constitute nonlocking mating tapers and the secondary set of mating plug and socket surfaces constitute holding tapers. These engaging tapered surfaces together provide an interference fit upon plug and socket engagement. The double taper interference fit of the engaging surfaces provides high electrical integrity upon plug and socket engagement, but minimal disconnecting frictional encounter upon plug and socket disengagement.

Each connector body portion has perimetric resilient flange. The engagement and securement of these flanges provides environmental sealing.

6 Claims, 4 Drawing Figures

HIGH VOLTAGE ELECTRICAL CONNECTOR

CROSS REFERENCE TO RELATED APPLICATION

This is a continuation of application Ser. No. 577,065 filed May 13, 1975, now abandoned; which is a continuation-in-part of application Ser. No. 470,943 filed May 17, 1974 in the name of Roy M. Broad for High Voltage Electrical Connector, now abandoned.

BACKGROUND OF THE INVENTION

This invention relates to electrical connectors and more particularly to universal electrical connectors suitable for terminus applications in high voltage cable environments.

In high voltage terminus applications, corona occurrence has always presented problems related to application efficiency and insulation deterioration. Many proposals have been made to increase the efficiency and reduce the effects of corona. As a result, elaborate and expensive high voltage terminal devices, such as cable connectors, splices, and joints have been designed to provide trouble-free junctures and terminations.

In recent years, there has been an increased demand, particularly from the power industry, to provide electrical connectors, terminators and couplings for high voltage applications having higher KV ratings, but which are more compact than previously contemplated. As a result, more complex and intricate connectors have been developed to meet higher connector requirements.

The complexities of the prior art connectors can make proper installation difficult. Accordingly, the reliability of connector installation depends a great deal upon the skills of the installer.

The connector and terminus devices in many cases are of a permanent or semi-permanent nature. In those cases where the connection is said to be readily disconnectable, difficulty has been experienced in disassembly.

The difficulty in disassembly of these connectors is usually due to interengagement of the plug and socket portions of the connection in a highly positive interference fit along an extended shallow taper interface. The interengagement includes engaging tapered surfaces on the plug and socket portions that are substantially parallel to the axis of the connection or joint providing a tight frictional fitting connection.

These engaging surfaces also cause problems on connection. Air becomes entrapped between and within connector body portions. A pneumatic effect develops, preventing final sealing together of the body portions. A variety of expedients have been resorted to in an attempt to bleed off air. An example is the employment of a nylon rod or tube positioned in the interface between the engaging tapered surfaces of the connector body portions. All of these expedients cause difficulties and few assure success.

SUMMARY OF THE INVENTION

The principal feature of this invention is an electrical connector suitable for high voltage applications where the insulating body portions employ a combination of engaging primary and secondary tapers on each connector body portion. These engaging tapers provide an interference fit.

The electrical connector of the present invention consists of two insulative resilient body portions each having an outer semiconductive layer. A portion of a central bore in each body portion is provided with a semiconductive liner. The contour of the bore is formed to receive an electrical contact secured to the end of a high voltage cable conductor. One body portion is provided with a plug member and the other body portion is provided with a mating socket member.

Each member has two tapered surfaces which are adapted to engage corresponding tapered surfaces on the other mating member. One set of engaging surfaces constitute nonlocking mating tapers to provide for aligned seating of the plug and socket members and pneumatic bleeding of air within the confines of the connector. These nonlocking tapers are short in length, frusto-conical in shape, and have a wide angular relationship relative to the axial extent of the connector body portions. The wide angle tapers provide a tight interface upon plug and socket engagement regardless of the existence, for example, of minute surface irregularities produced on the tapered surfaces during molding of the body portions. Due to the wide tapered contour of these surfaces, therefore, minute deformities in engaging surfaces cannot play a part in producing voids in higher stress areas of the insulative body portions. As a result, high electrical integrity is established by these engaging tapers upon plug and socket engagement.

The other set of engaging surfaces constitute a holding taper. This secondary set of tapers are short in length as compared to the length of the shallow tapers found on comparable connectors of the past. The length of the secondary tapers need not be extensive due to the excellent electrical integrity established by the primary set of engaging tapers.

The primary and secondary taper sets provide an interference fit. However, due to the short length of these tapers and the nature of the primary tapers, it is not necessary to force or twist together the connector body portions for assembly or disassembly. Good electrical integrity is established by insertion and sealing of the plug member into the socket member.

Each connector body portion is provided with a perimetric resilient flange near its forward end so that the body portions can be secured together by an convenient securing device. The securing of the body portion flanges together provides environmental sealing for the connector. This securance also insures a tighter seal between the mating tapered surfaces of the connector plug and socket members. Because the flanges are resilient, undesirable force fitting and improper deformation of the members is not possible.

An offset is provided in a portion of the interface between the body portion flanges to improve environmental sealing and provide good electrical continuity between the outer body portion semiconductive layers upon assembly and securance.

The electical female contact provided in a connector body portion has an annular recess in the contact bore. A metallic conductor strip is employed in this recess to improve the electrical connection between interconnected contacts. Each conductor strip has a plurality of parallel tongues connected to spaced strip edge portions. Each tongue is perpendicular to the principal dimension of the strip. The tongues are separated from one another by slits. Each tongue projects obliquely beyond the faces of the strip. The oblique relationship of each tongue provides a biasing action against the engaging surfaces of mating electrical contacts. This biasing action provides unexcelled electrical contact characteristics between the tongues and the mating contact surfaces.

BRIEF DESCRIPTION OF THE DRAWINGS

Other objects and advantages appear in the following description and claims.

The accompanying drawings show, for the purpose of exemplification without limiting the invention or the claims thereto, certain practical embodiments illustrating the principles of this invention wherein:

A high voltage universal electrical connector is shown generally at 10 in FIGS. 1, 2 and 3. The figures show the connector employed in different high voltage environments. Identical numerals are used to identify identical parts in each of these figures.

Figure 1:
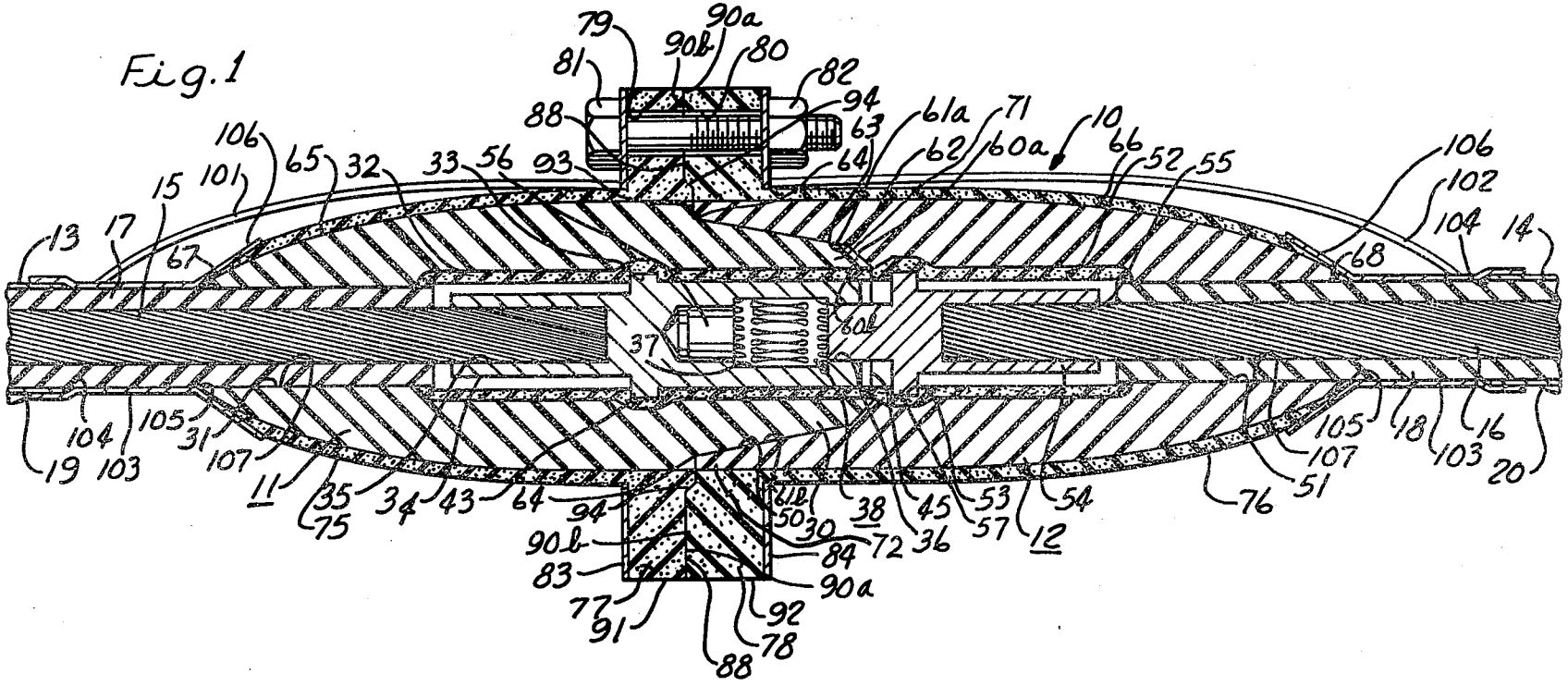
FIG. 1 is a cross-sectional longitudinal view of the electrical connector of this invention.
Figure 2:
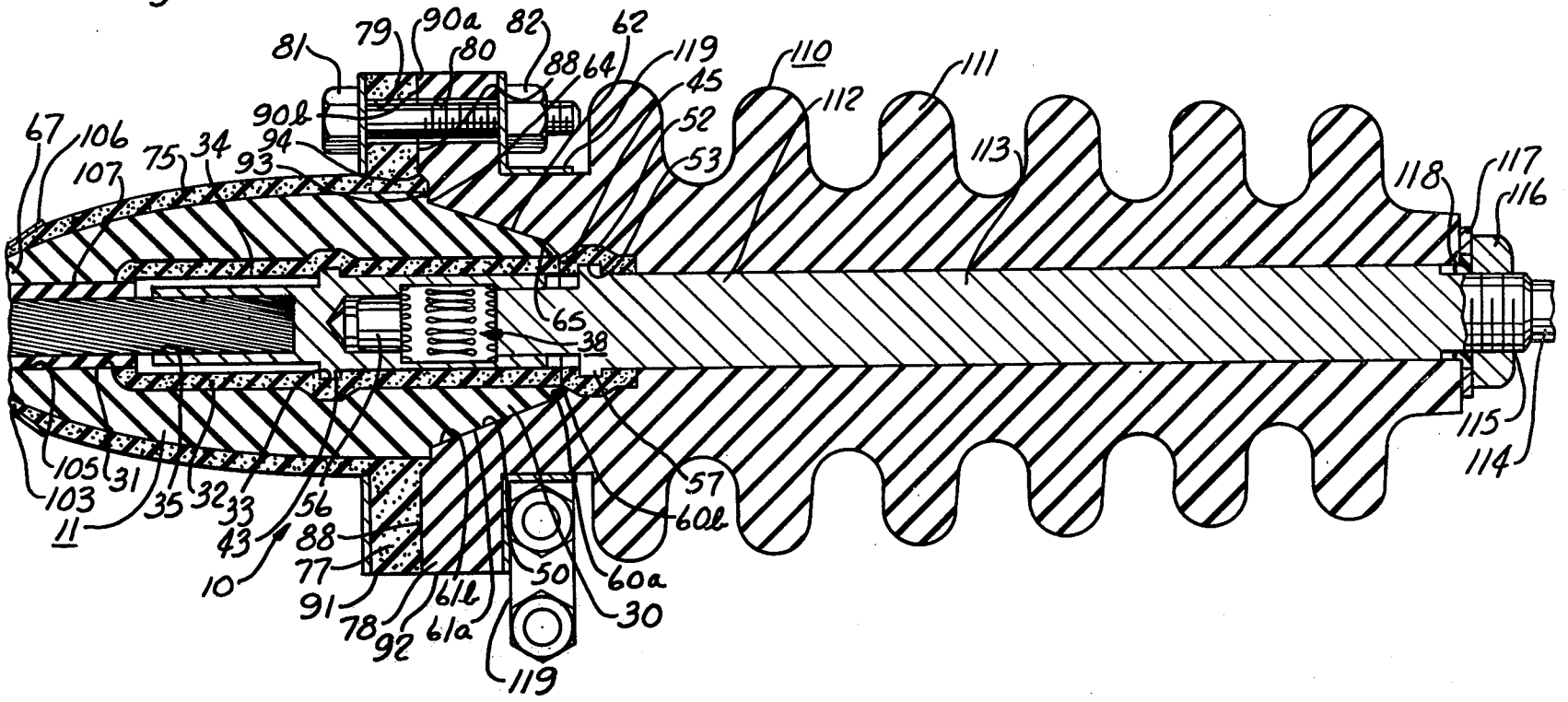
FIG. 2 is a cross-sectional longitudinal view of the electrical connector of this invention as employed as a terminator.
Figure 3:
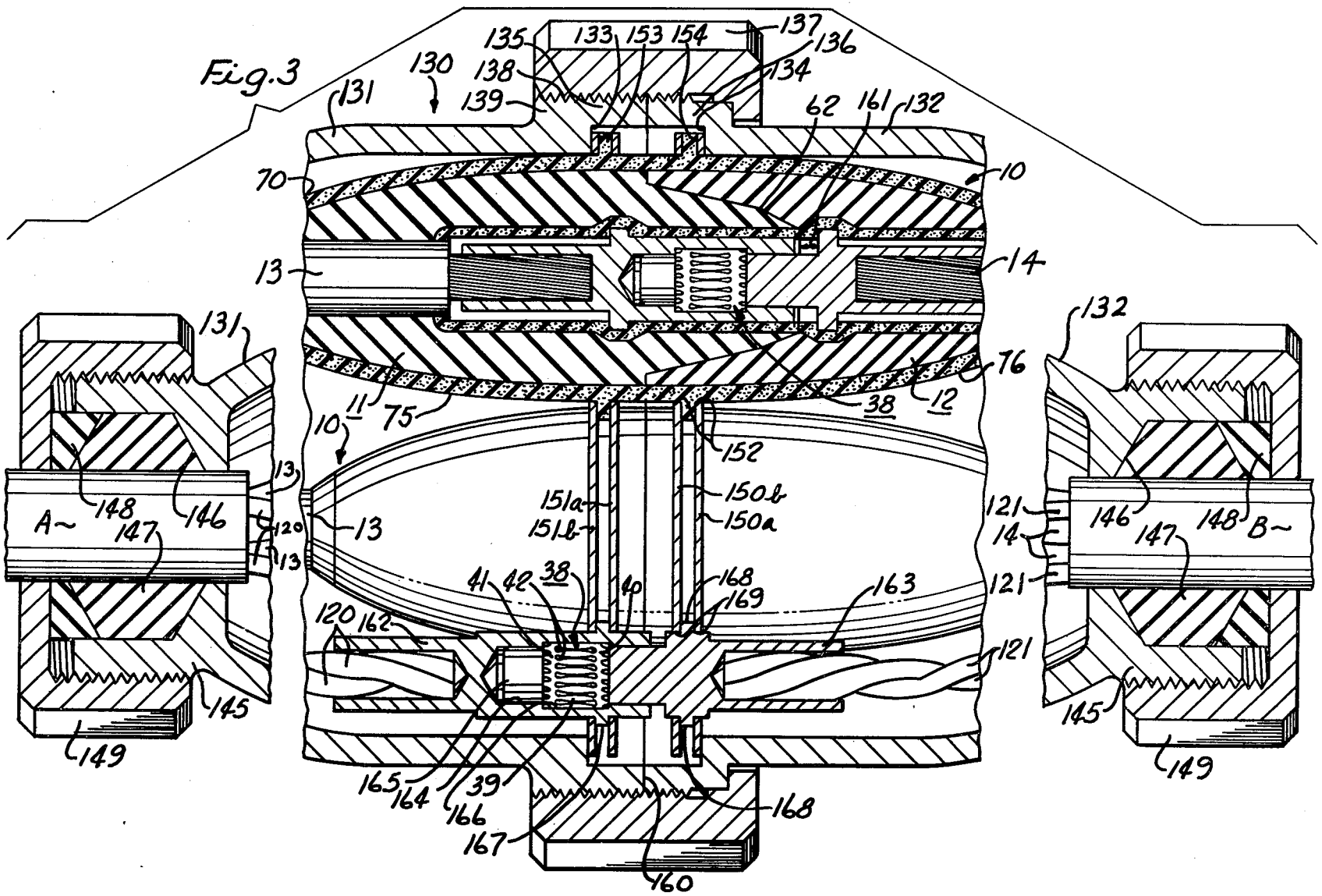
FIG. 3 is a cross-sectional longitudinal view of the electrical connector of this invention supported in a high voltage cable coupler as taken along the plane represented by line 3—3 of FIG. 4.

The connector 10 of FIG. 1 illustrates the connector joining the ends of high voltage cables. The illustration in FIG. 2 illustrates the use of a portion of the connector 10 in conjunction with a terminator. The illustration of FIG. 3 is the use of a plurality of connectors 10 in conjunction with a high voltage cable coupler.

The universal electrical connector 10 consists of two resilient, insulative, body portions 11 and 12. The portions 11 and 12 are made of suitable dielectric material, such as ethylene propylene diene modified (EPDM). Cables 13 and 14 are connected to body portions 11 and 12, respectively. The cables 13 and 14 are respectively provided with centrally located conductors 15 and 16. Insulative layers 17 and 18, respectively, surround the conductors 15 and 16. Outer metallic shielding shown at 19 and 20, is provided over the insulation layers 17 and 18, respectively.

The body portion 11 is provided with a forward projecting section 30. This section 30 serves as a plug member. The body portion 11 also has a central bore 31. A portion of the bore is defined by an inner semiconductive liner 32. The inner semiconductive liner 32 has an annular recess 33.

A female electrical contact 34 is properly positioned within the bore 31 by an annular shoulder 43 on the contact. Upon insertion of the contact 34 within the bore 31, the annular shoulder 43 will become engaged by the walls of the annular recess 33. Thus, the contact 34 is properly positioned within the body portion 11 and is held in a secure position for connecting the body portions 11 and 12. The contact is retained in the body portion 11 by coaction with the walls of the recess 33.

The female contact 34 has a rearward cylindrical bore 35 to receive the conductor 15 of cable 13. The conductor 15 is secured within the bore 35 by any convenient means such as crimping.

The forward end of the female electrical contact 34 is also provided with a cylindrical bore 36. The bore 36 is, in turn, provided with an annular recess 37. A metallic conductor strip 38 is disposed in the recess 37.

Good electrical contact is assured by the strip 38. The electrical conductor strip 38 is described in detail in U.S. Pat. No. 3,453,587. In general, strip 38 consists of a plurality of spaced tongues 39 (see FIG. 3 in particular). The ends of each tongue 39 are respectively connected to marginal portions 40 and 41 of the strip. A plurality of slits 41 separate each of the parallel tongues 39. Each of the tongues 39 is positioned to be oblique so as to project beyond both faces of the strip. The strip 38 is circularly bent to fit within the annular recess 37. The metallic conductor strip 38, due to the oblique nature of the tongues 39, provides an excellent contact engagement between the male pin 56 and the female recess 37 via the tongues 39. The edges of the tongues 39 grip the surfaces of contacts 34 and 54 in a positive manner. Strip 38 may be positioned either on male pin 56 or in female recess 36 prior of assembly as desired.

Although the female electrical contact 34 is designed for insertion into the bore 31 through the plug member 30, provision could be made for modification to the bore 31 at the rearward extent 67 of the body portion 11 to receive the contact 34. This would facilitate assembly of the connector body portion 11 to the cable where the electrical contact 34 has previously been connected to the cable conductor 15.

The body portion 12 is provided with an inward projecting section 50 which functions as a socket member. In use, the plug member 30 is inserted into the socket member 50.

The body portion 12 also has a centrally located bore 51. A portion of the bore 51 is defined by an inner, substantially cylindrical semiconductive liner 51. The inner liner 52 is provided with an annular recess 53.

The inner semiconductive liners 32 and 52 of body portions 11 and 12, prevent the formation of corona in the electrical contact chamber defined by the liners. These linears engage one another at interference 45 upon interengagement of the plug and socket members 30 and 50.

A male electrical contact 54 is provided for body portion 12. The male contact 54 has a cylindrical bore 55 at its rearward end. The bore 55 receives the electrical conductor 16. The male contact is secured to the cable 16 such as by crimping.

A male contact pin 56 is provided at the forward end of the contact 54. As previously indicated, the pin 56 is insertable in the female bore 36 of the female contact 34. The forward end of the male pin 56 is spaced from the base of the female contact bore 36. This is to insure that coaction of the contacts does not interfere with proper interengagement of the plug and socket members 30 and 50.

The male electrical contact 54 is also provided with an annular shoulder 57. The shoulder 57 engages the walls of the annular recess 53 when the contact 54 is properly located in the body portion 12.

It is quite feasible to insert the male electrical contact 54 at the rearward extent of bore 51 of body portion 12 in a manner similar to that mentioned in connection with female electrical contact 34. As mentioned, this would be a matter of convenience in those situations where the electrical contact has already been connected to the conductor of a cable.

The plug member 30 of body portion 11 and the socket member 50 of the body portion 12 are such provided with two mating surfaces **60*a*, 60*b*, 61*a* and 61*b*, respectively. Each of these mating surfaces is frustoconical in shape. Plug member 30 has engaging surfaces 60*a* and 61*a* and socket member 50 has mating surfaces 60*b* and 61*b*, so that upon the connection of body portions 11 and 12, a tight fit is provided at their interface 62**.

The slant or taper height of mating surfaces 60*a* and 60*b* is shorter than that of mating surfaces 61*a* and 61*b*.

The uniqueness of interengaging surfaces 60*a*, 60*b*, 61*a* and 61*b*, is at least two-fold. First, the interengaging surfaces 60*a* and 60*b* provide an aligning and nonlocking taper. As can be readily seen in FIG. 1, the angular relationship of these engaging surfaces 60*a* and 60*b* relative to the axial extent of the connector 10 is approximately 30°. Generally, a nonlocking taper could be provided within an angular range of 17° to 60° relative to the axial extent of the connector. This angular range is determined by a lower limit that has a sufficient angular magnitude so as not to constitute a locking taper and an upper limit that has an angular magnitude that does not exceed inteference fit capabilities. At the lower limit, angular relationships below 17° provide positive locking tapers. At the upper limit, angular relationships above 60° do not provide tapers that can produce an interference fit necessary for good electrical integrity.

Secondly, the angular relationship of the interengaging surfaces 61*a* and 61*b* is more closely aligned to the axis of the connector 10. These surfaces 61*a* and 61*b* are of relatively short length, and provide a holding taper for the connector. Their angular relationship with the connector axis is approximately 7°. This angular relationship should be greater than 0°, but not exceed 17°.

A slightly positive interference fit is provided by surfaces 60*a*, 60*b*, 61*a* and 61*b* along the interface 62. This interference fit is due partly to the fact that the plug member 30 may be somewhat marginally larger than the socket member 50. The dimensional difference is very slight, for example, not being more than one one-thousandth of an inch. The interference fit is also due partly to a very slight expansive nature brought upon body portion plug member 30 due to insertion of the electrical contact 34 into the bore 31. Further, the interference fit is believed to be aided by the fact that the forward portion or nose 71 of the plug member 30 is more resilient than the inner area at surface 60*b* of the socket member 50. By the same token, the outer resilient portion or flange 72 of the socket member 50 is more resilient than the area of plug member 30 represented by tapered surface 61*a*. Upon plug and socket engagement, nose 71 may be slightly compressed while the flange 72 may be slightly expanded to provide a snug but not highly frictional interference fit.

While there is an interference fit, connection and disconnection of the members 30 and 50 is simple because the lengths of the interfacing surfaces 60*a*, 60*b*, 61*a* and 61*b* are short and the angular relationship between these surfaces is very extensive, approximately 143°. In addition, the entrapped air problems experienced with prior connectors are eliminated. The primary tapered surfaces 60*a* and 60*b* seat prior to snug interengagement and sealing of the tapered surfaces 61*a* and 61*b*.

Expressed in another manner, this interference fit along the interface 62 is not sufficient to interfere with or make difficult the assembly or disassembly of the connector body portions 11 and 12. On the other hand, the interference fit that is established along the engaging tapered surfaces is more than adequate to assure a good electrical connection.

One of the outstanding features of the connector 10 is that tests have shown higher ratings, particularly corona extinction levels, as compared to prior art connectors used for the same system voltage level. For example, for a typically dimensioned KV connector 10 with an operating voltage of 8.7 KV from line to ground, the following basic electrical specifications were obtained:

Corona extinction level (securance of body portions 11 and 12 together and shielding provided between cable shield and body portions): 25 KV to ground;

AC 1 minute Withstand Voltage 60 $H_z$: 50 KV.

Generally accepted levels for a 15 KV high voltage splice are 11 KV to ground for corona extinction level and 35 KV for the 1 minute withstand.

Testing has proven unusually high electrical performance. This performance is accredited to the fact that the plug and socket members 30 and 50 have steep engaging tapered surfaces 60*a* and 60*b*. Connector body portions having extended shallow angle, tapered engaging surfaces have an increased chance of minute surface imperfections or inaccuracies occurring in molding, which play an important role in void formation between mating engaging surfaces. Although greater frictional engagement and a substantial interference fit may be achieved between such shallow tapered mating surfaces, final seating together of connector body portions carrying this type of mating surfaces will not eliminate these minute imperfections. This is believed to be primarily due to the fact that the compressive forces that would resiliently press out, smooth and exclude these minute imperfections are practically in alignment with the longitudinal extent of the interface between mating surfaces, i.e., almost parallel to the axial extent of the connector.

As a result, the presence of voids and resultant corona formation cannot be completely eliminated at the interface between such shallow tapered surfaces unless perfectly molded surfaces and exact fitting molded tapers can be obtained. This, of course, is not possible.

By employing the wide angle tapered surfaces 60*a* and 60*b*, minute imperfections (minute cavities or minute protuberances) in these surfaces cannot provide for void formation upon plug and socket member engagement. This is because these surfaces 60*a* and 60*b* are substantially transverse to the axial extent of the electrical connector 10, but not so transverse as to eliminate an interference fit. These mating surfaces are substantially transverse to the above-mentioned compressive forces. Void formation is substantially reduced, if not practically eliminated.

The steep tapered surfaces 60*a* and 60*b* are positioned at the higher stress areas closer to the cable conductors 15 and 16. The higher electrical performance, previously indicated, is believed to be obtained by these steep tapered engaging surfaces excluding the formation of voids along the interface 62 at critical areas close to the high voltage cable conductors.

Because of the foregoing, higher voltage gradients can be provided along the interface 62. The maximum permissible longitudinal stress provided along the internal creepage path in a high voltage electrical connector is generally designed to be 2 volts per mil. However, the taper design of the plug and socket members 30 and 50 permits an increase in stress along the internal creepage path, represented by interface 62, to 6 volts per mil.

If the electrical stress along the internal creepage path at interface 62 may be higher, the tapered engaging surfaces 60 and 61 need not be as long as that found on prior connector body portions having extended shallow tapered engaging surfaces. For example, a 15 KV connector having an operating voltage of 8.7 KV to ground is generally designed to have a maximum of 2 volts per mil. The length of the engaging surfaces on the connector body portions would be designed to be approximately 4.35 inches. However, the length of the tapered engaging surfaces 60 and 61 of a 15 KV connector 10 would be approximately 1.457 inches. Thus, a large reduction in connector length can be realized employing the double tapered structure of connector 10.

As previously indicated, the nose 71 tends to seat prior to final engagement and complete seating of the mating surfaces 61*a* and 61*b*. Because of this sequence in seating, there is much less tendency for air entrapment during plug and socket member engagement. The connector plug and socket members 30 and 50 are "self ventilating," requiring no special aids to be used in assembling the plug and socket members.

The resilient body portions 11 and 12 are respectively provided with outer curved surfaces 65 and 66. The surfaces 65 and 66 curve to locations 67 and 68 at the ends of the body portions 11 and 12. The surfaces 65 and 66 are substantially hyperbolic in cross-sectional shape.

Each of the outer portion surfaces 65 and 66 is provided with an outer semiconductive resilient layer 75 and 76. These outer layers 75 and 76 are molded integral to the resilient insulative body portions 11 and 12. The rearward extents of outer semiconductive layers 75 and 76 are tapered as best shown in FIG. 3, to provide frusto-conical surfaces 70.

The forward ends of the outer semiconductive layers 75 and 76 respectively include, integral perimetric flanges 77 and 78. Aligned openings 79 and 80 at various locations along flanges 77 and 78 are provided for the purpose of fastening together the body portions 11 and 12 by means of a fastening device such as bolts 81 and nuts 82, one of each being shown in FIG. 1.

Metallic clamping rings 83 and 84 are employed to facilitate fastening the flanges 77 and 78. The rings 83 and 84 provide a washer surface for the fastening devices as well as spreading clamping forces uniformly about the resilient flanges.

The fastening devices employed in connection with the flanges 77 and 78 need not be tightly drawn to form an environmental seal at the interface 88 of the engaging flange faces 90*a* and 90*b*. An effective seal is formed by moderate tightening of these devices. Also, it will be noted that the degree of tightening does not interfere with the proper interengagement of plug and socket members 30 and 50. There is no force fitting of these members together.

An interface 88 extends from a root 64 to the outer edges of circumferential surfaces 91 and 92 of the flanges 77 and 78. A short intermediate interface segment is provided between body portions 11 and 12 as identified at 93. This short interface segment 93 is considered as part of the overall interface 88. The interface segment 93 is not part of semiconductive engaging faces 90*a* and 90*b* of the flanges 77 and 78.

The engaging surfaces 90*a* and 90*b* are provided with a diagonal offset identified at 94. The offset 94 in interface 88 not only assures environmental sealing, but also provides for excellent electrical continuity between the semiconductive layers 75 and 76.

Ground continuity between the cables 13 and 14 is established by ground leads 101 and 102. These ground leads 101 and 102 are connected together by the bolt 81 and nut 82 as shown in FIG. 1.

A heat shrinkable semiconductive tube 103 provides proper connection between the outer semiconductive layers 75 and 76 and the outer metallic shielding 19 and 20 of cables 13 and 14. The surfaces of insulation 17 and 18 of conductors 13 and 14 between the metallic shields 19 and 20 and the end locations 67 and 68 of the body portions 11 and 12 are covered with a conductive paint. The heat shrinkable semiconductive tubing 103 is slipped over the cable ends prior to connection of the body portions 11 and 12 to the cable ends. It is then slipped forward over the conductive paint and then heat shrunk into position as shown in FIG. 1. Semiconductive tape may be used in lieu of the heat shrinkable semiconductive tubing 103.

The heat shrinkable tubing 103 provides a tight void-free engagement with the surfaces of the metallic shield, cable insulation and body portion ends 67 and 68. In particular, the employment of a conductive coating in connection with the tubing 103 eliminates the formation of voids at the critical places, such as, at the terminus of the cable metallic shielding 19 and 20, indicated at 104 and at the terminus of the body portions 11 and 12, indicated at 105.

The conical shaped semiconductive layer portion 70 of the semiconductive layers 75 and 76 as shown in FIG. 3 provides a similar conical shape to the heat shrunk semiconductive tubing 103 as indicated at 106 in FIGS. 1 and 2. The tubing portion 106 at this point together with the semiconductive portion 70 of the outer semiconductive layers 75 and 76 represent the establishment of a stress relief cone to provide uniform distribution of electrical stress at these critical points of cable termination regardless of cable insulation eccentricity.

It should also be noted that the length of the internal creepage path at interface 62 is substantially the same length of the internal creepage path established between the insulation layer of the cables and the insulative body portions established at interface 107 along the rearward lengths of the body portion bores 31 and 51.

Each of the body portions 11 and 12 of connector 10 can be constructed to accomodate different size conductors and conductors of different metallic material, such as aluminum and copper. Thus, it is possible to use the connector 10 for coupling together different sizes of conductors and different material types of conductors.

FIG. 2 represents another application of the electrical connector 10 of this invention. In the application shown, the body portion 11 is identical to that shown in FIG. 1. The other body portion takes the form of a terminator 110. The terminator includes an insulator 111 which is composed of resilient insulating material, such as molded rubber. The terminator is provided with the same features included in the socket member 50 of the body portion 12. A male contact 112 is provided with the male contact pin 56. The annular shoulder 57 of contact 112 engages the walls of the annular recess 53. The male contact 112 is also provided with an elongated shank 113 which terminates in male connection pin 114.

The insulator 111 is secured in position relative to the male electrical contact 112 by means of threaded engagement indicated at 115 between a shank 113 and a nut 116. A metallic washer 117 is provided under the nut 116. The washer 117 has an inner annular elastomeric seal 118 to prevent environmental contamination within the interior of the terminator 110.

A metallic strap 119 provides a convenient means for securing the terminator 110 in its proper place of application.

Figure 4:
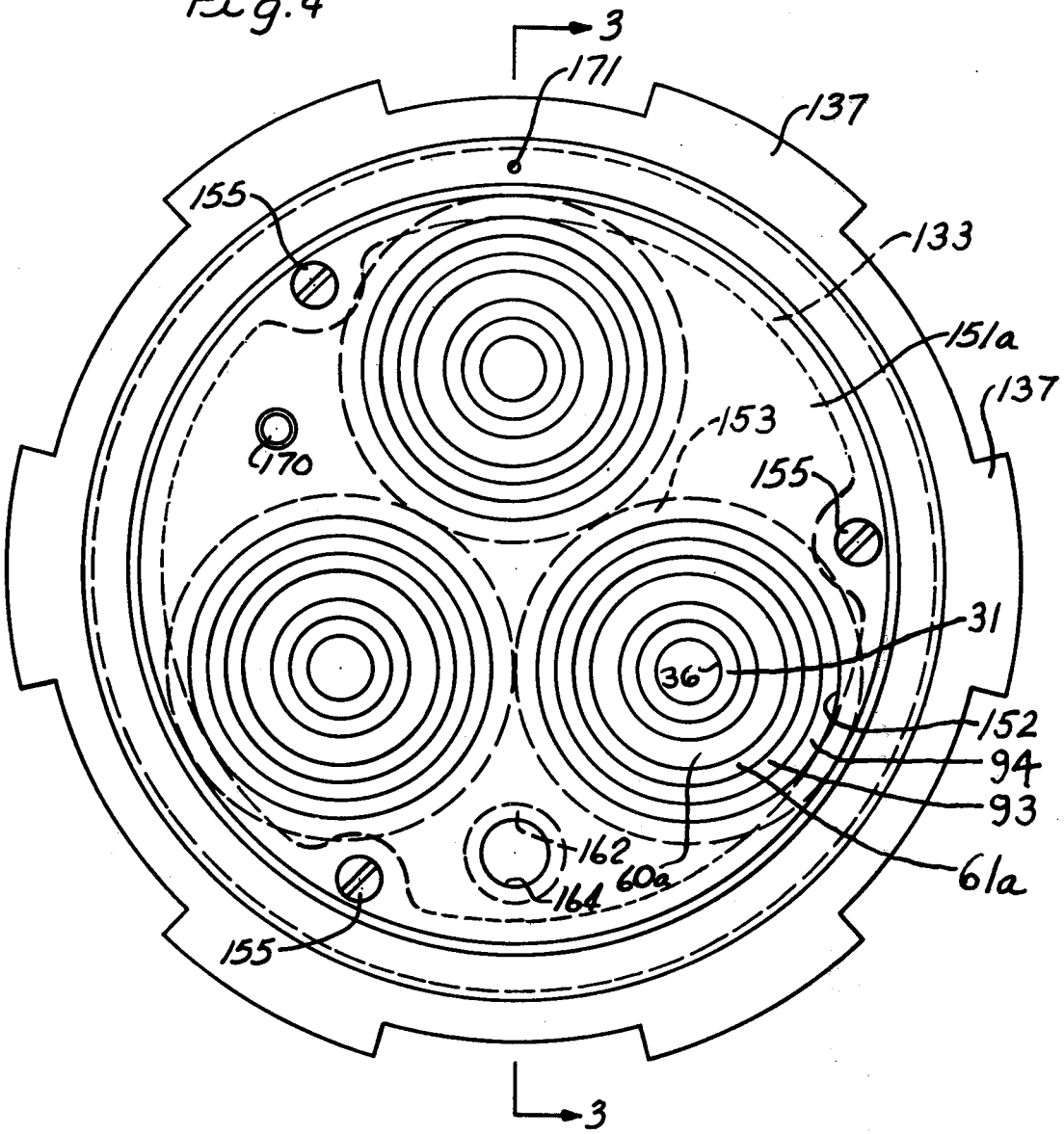
FIG. 4 is a forward end view of a coupler housing section of the coupler shown in FIG. 3.

The employment of the electrical connector 10 in a high voltage cable coupler is shown in FIGS. 3 and 4. Three of the connectors 10 are shown in connection with multiple high voltage cable A and B. Multiple high voltage cable A includes three cables 13, two of which are shown in FIG. 3. Multiple high voltage cable B includes three high voltage cables 14, two of which are shown in FIG. 3. Also included are ground wires 120 of multiple high voltage cable A and ground wires 121 of multiple high voltage cable B.

For purposes of simplicity, the heat shrinkable semiconductive tubing 103 illustrated in connection with the connector 10 of FIGS. 1 and 2 is not shown in the coupler structure of FIG. 3.

The coupler 130 includes housing sections 131 and 132. The forward end of housing sections 131 and 132 are provided with annular shoulders or recesses 133 and 134 respectively. The annular shoulders 133 and 134 respectively include annular flanges 135 and 136.

The housing section 132 is provided with closing ring 137. The flange 135 has an annular threaded section 139 in threaded engagement at 138 with the closing ring 137.

Each end of the housing sections 131 and 132 is provided with a cable entrance 145 which includes a chamber 146. A cable entrance gland 147 is provided in the chamber 146 to seal the rearward end of the multiple cables A and B. Environmental sealing is accomplished by employment of a gasket slip ring 148 which is brought into tight engagement against the gland 147 by means of an end cap 149.

The electrical connectors 10 are held in proper spaced and aligned relationship within the housing sections 131 and 132 of the coupler 130 by two pairs of support plates 150*a*, 150*b*, 151*a* and 151*b*. An opening 152 is provided in each of support plates 150 and 151 to properly support the body portions 11 and 12 of the electrical connectors 10 in the aligned relationship.

The electrical connectors 10 as shown in FIG. 3 are not provided with the semiconductor fastening flanges 77 and 78 as shown in FIGS. 1 and 2. Rather, the connectors 10 in FIG. 3 are provided with annular resilient semiconductive support flanges 153 and 154 on connector body portions 11 and 12, respectively. The body portion 11 is supported by the pair of support plates 151*a* and 151*b* via their openings 152 as positioned on adjacent sides of an annular support flange 153 on the body portion 11. The pair of support plates 150*a* and 150*b* support the body portion 12 via their annular openings 152, each respective plate is positioned on adjacent sides of the annular support flange 154.

These pairs of support plates not only provide good rigidity in coupler structure but also insure properly aligned relationship of each of the respective body portions 11 relative to the connected body portions 12.

The pairs of support plates 150*a*, 150*b*, 151*a* and 151*b* are held in secured relationship by bolt member 155, shown in FIG. 4. The pairs of support plates 150 and 151 are held in secured engagement against the respective annular shoulders 133 and 134 of the housing sections 131 and 132. This provides a fixed determined relationship of the interengagement of each of the body portions 11 and 12. Stop faces of flanges 135 and 136, at interface 160 between the housing sections 131 and 132, prevent undesirable forced interengagement between the body portions 11 and 12. This is represented by the spacing provided between the male and female electrical contacts 34 and 54 as represented by the arrow 161 in FIG. 3. Forcing of these body portions 11 and 12 further together would cause distortion along the interface 62 introducing the possibility of air voids being established along this interface. Air voids introduce the change of corona and reduce the effective high voltage capacity of the coupling.

As shown in FIG. 3, the respective ground wires 120 and 121 are twisted together at their ends. The ground wires are secured to female ground contact 162 and male ground contact 163, respectively. The female ground contact 162 is provided with a cylindrical receiving bore 164. The male ground contact has a pin 165 which is received in the bore 164. The bore 164 of the female ground contact 162 is provided with an annular recess 166 to receive one of the metallic conductor strips 38 in a manner previously explained in connection with the conductor strip shown in FIG. 1.

The female ground contact 162 is provided with an annular support shoulder 167. The male ground contact 163 is provided with external annular support shoulder 168. The pairs of support plates 150 and 151 are provided with openings 169 in order to receive shoulders 168 and 167 between the support plates in the manner illustrated in FIG. 3. In this manner, the female ground contact 162 and the male ground contact 163 are supported in proper aligned relationship in the respective housing sections 131 and 132.

As shown best in FIG. 4, a ground check female contact is illustrated at 170. As is conventional, the multiple high voltage cables A and B are generally provided with ground check conductors for the purpose of monitoring the integrity of the ground lead connection in the event of unplanned energization of the circuit to which the cables are connected.

We claim:

1. A universal electrical connector particularly adaptable for terminus applications of high voltage cables having a central conductor covered by an insulative layer comprising:

two resilient body portions, one being a plug member and the other being a mating socket member, each of said body portions provided with a central bore, an inner semiconductive liner provided in a portion of each of said bores having an annular recess provided therein, a female contact insertable in said plug bore and a male contact insertable in said socket bore, each of said contacts provided with an annular shoulder positioned in corresponding of said annular recesses, said members each provided with two concentric frusto-conical mating surfaces, the slant height of the first innermost of such mating surfaces being shorter than the second of such mating surfaces, said first surfaces constituting a nonlocking taper and said second surfaces constituting a holding taper, an outer resilient semiconductive layer for the full length of said body portions, a resilient semiconductive perimetral flange integral with its respective outer semiconductive layer, and means to releasably secure said flanges together upon interengagement of said plug socket members.

2. The electrical connector of claim 1 characterized by an offset in the engaging faces of said perimetric flanges to provide good electrical continuity of said body portion outer semiconductive layers upon application of said securing means.

3. A universal electrical connector for terminus applications of high voltage cables having a central conductor surrounded by an insulative layer comprising:

two interengaging resilient insulative body portions each having a central bore, one of said body portions forming a plug member and the other of said body portions forming a mating socket member, each of said members having two frusto-conically shaped surfaces, each of said surfaces on one of said members being a mate for a corresponding surface on the other of said members, one set of said mating surfaces constituting a nonlocking taper and the other set of said mating surfaces constituting a holding taper, said other set of said mating surfaces terminating at a root, an outer semiconductive layer covering each of said body portions, a perimetric flange formed on the forward portion of each of said body portions and terminating at said root, said flanges being integral with said outer semiconductive layers, and means to releasably secure said flanges upon interengagement of said plug and socket members, said contact means includes a female contact recess and a male contact plug, a metallic conductor strip included with one of said contact means and comprising a metallic conductor strip having a plurality of resiliently deformable, substantially parallel tongues separated from one another by slits transverse to the principal dimension of said strip, said tongues being connected at both ends with said strip while projecting obliquely beyond both faces of the strip.

4. In a high voltage cable coupler assembly for releasably connecting together one or more high voltage cables, a universal electrical connector for connecting together the terminus of at least two cable conductors in the coupler assembly comprising:

two interengaging resilient insulative body portions each having a central bore, one of said body portions forming a plug member and the other of said body portions forming a mating socket member, contact means inserted in said body bores and adapted for interconnection upon assembly of said plug and socket members, said members each provided with two concentric frusto-conical mating surfaces with both of said surfaces of each member facing the same longitudinal direction thereof, the slant height of the first innermost of such mating surfaces being shorter than the second of such mating surfaces and emanating from said central bores, said first surfaces constituting a nonlocking taper and said second surfaces constituting a holding taper, first support plate means having openings, one of said body portions supported in one of said first support plate means openings, second support plate means having openings, the other of said body portions supported in one of said second support plate means openings, said coupler assembly including two housing sections, means to secure in aligned relation said first support plate means in the forward end of one housing section and said second support plate means in the forward end of the other housing section for aligned coupling engagement, and means to releasably connect together said housing sections permitting aligned assembly of said plug and socket members.

5. The coupler assembly of claim 4 including stop means on the forward ends of said housing sections to prevent the forced engagement of said plug member into said socket member upon connecting together said housing sections.

6. The coupler assembly of claim 4 including a resilient perimetric flange formed integrally to each of said body portions, said first and second support plate means each comprising a pair of support plates sandwiching said perimetric flange therebetween.

* * * * *

UNITED STATES PATENT OFFICE

CERTIFICATE OF CORRECTION

Patent No. 4,074,926 Dated February 21, 1978

Inventor(s) Roy M. Broad

It is certified that error appears in the above-identified patent and that said Letters Patent are hereby corrected as shown below:

Col. 2, line 56, erase "electical" and substitute --electrical--

Col. 4, line 30, erase "51" and substitute --52--

Col. 4, line 35, erase "linears" and substitute --liners--

Col. 8, line 40, erase "accomodate" and substitute --accommodate--

Col. 10, line 36, erase "We" and substitute --I--

Col. 10, line 62, erase "perimetral" and substitute --perimetric--

Signed and Sealed this

*Fifth* Day of *September 1978*

[SEAL]

*Attest:*

RUTH C. MASON
*Attesting Officer*

DONALD W. BANNER
*Commissioner of Patents and Trademarks*